US006552481B2

(12) United States Patent
Furusawa et al.

(10) Patent No.: US 6,552,481 B2
(45) Date of Patent: Apr. 22, 2003

(54) COLOR CATHODE RAY TUBE HAVING DEFORMATION-RESISTANT SHADOW MASK

(75) Inventors: Takeharu Furusawa, Mobara (JP); Nobuhiko Hosotani, Mobara (JP); Sadao Umezawa, Mito (JP)

(73) Assignee: Hitachi Ltd., Tokyo (JP)

( * ) Notice: Subject to any disclaimer, the term of this patent is extended or adjusted under 35 U.S.C. 154(b) by 168 days.

(21) Appl. No.: 09/754,633

(22) Filed: Jan. 4, 2001

(65) Prior Publication Data

US 2001/0007408 A1 Jul. 12, 2001

(30) Foreign Application Priority Data

Jan. 11, 2000 (JP) ..... 2000-006095

(51) Int. Cl.[7] ..... H01J 29/80
(52) U.S. Cl. ..... 313/407
(58) Field of Search ..... 313/364, 402, 313/403, 404, 407

(56) References Cited

U.S. PATENT DOCUMENTS 4,191,909 A * 3/1980 Dougherty ..... 313/402
4,767,962 A 8/1988 Adler et al. ..... 313/402
5,610,473 A * 3/1997 Yokota et al. ..... 313/402
6,384,522 B1 * 5/2002 Tani et al. ..... 313/402

FOREIGN PATENT DOCUMENTS

| | | |
|---|---|---|
| EP | 0 372 630 A2 | 6/1990 |
| EP | 0 813 225 A2 | 12/1997 |
| FR | 2 756 971 | 11/1997 |
| JP | 09035657 | 7/1997 |

OTHER PUBLICATIONS

EPO Search Report and Annex, EP 01 10 0072, Completion Date: Dec. 19, 2001, Examiner Van den Bulcke, E.

* cited by examiner

*Primary Examiner*—Hoan Tran
(74) *Attorney, Agent, or Firm*—Milbank, Tweed, Hadely & McCloy LLP

(57) ABSTRACT

A color CRT suppresses deformation of the main shadow mask surface after fastening the shadow mask to the mask frame. Numerous substantially rectangular grooves or substantially circular recesses are formed in the damper part disposed to the shadow mask skirt so that the bending strength in the circumference direction of the skirt is greater than the bending strength in the direction parallel to the tube axis.

10 Claims, 8 Drawing Sheets

COLOR CATHODE RAY TUBE HAVING DEFORMATION-RESISTANT SHADOW MASK

BACKGROUND OF THE INVENTION

The present invention relates to a color cathode ray tube, and relates more particularly to a color cathode ray tube that suppresses deformation of the color selection electrode, of which a shadow mask is typical.

Color cathode ray tubes ("CRT" below) such as the shadow mask type color CRTs used in color televisions and color display monitors for office automation equipment have an approximately rectangular panel portion, a substantially cylindrical neck portion housing electron guns, and a substantially funnel-shaped funnel portion connecting the neck and panel portions to form a vacuum vessel, and a shadow mask fixed to a mask frame inside the vacuum vessel. The panel has a phosphor screen disposed on the inside surface thereof with numerous red (R), green (G), and blue (B) phosphor pixels arrayed in a dot or striped pattern. The shadow mask, which is a color selection electrode and is disposed in proximal opposition to the phosphor screen, has numerous electron beam apertures.

Thin metal sheets have been used to make the shadow mask in recent years as color CRT resolution has improved. Mild steel, invar, and other metals have been used for the shadow mask.

The shadow mask is manufactured by etching the numerous electron beam apertures into the thin metal sheet in specific positions, stamping the metal sheet to a specific outside shape, and then in a press shaping the sheet to form a curved main screen part and a skirt part that is contiguous to and bent approximately 90 degrees to the main screen part. The shaped shadow mask is then fastened to the mask frame to form a mask assembly.

So-called spring back occurs in the skirt part of this press-shaped shadow mask, thus causing the skirt part to warp to the outside, that is, in the direction away from the CRT axis. If the skirt is fastened to the mask frame to form the mask assembly with this spring back (warping) remaining in the skirt, deformation in the main surface of the shadow mask occurs as a result of this skirt warping, thus degrading CRT image quality.

Various measures have been conventionally used to prevent such deformation of the main shadow mask surface. Japanese Utility Model Laid-open No. 95353/1977, for example, teaches technology for disposing a strength adjusting part to the shadow mask skirt. Japanese Patent Laid-open No. 81444/1980, for example, teaches technology for imparting surface roughness to the inside surface of the shadow mask skirt as a means for scattering electron beams. Furthermore, Japanese Patent Laid-open No. 47649/1992 teaches technology for disposing hemispherical recesses of a specific diameter and depth to the outside of the shadow mask skirt.

Yet further, Japanese Patent Laid-open No. 112566/1974 teaches technology for locally thinning a peripheral part of the main surface of the shadow mask. In addition, Japanese Patent Laid-open No. 271849/1988 teaches technology for determining the length of the shadow mask skirt to a specific value relative to the outside diameter of the panel, and fastening the tab to the mask frame by means of tabs disposed to the skirt protruding from the skirt substantially parallel to the CRT axis in the direction away from the main surface. Yet further, Japanese Patent Laid-open No. 169847/1989 teaches technology for disposing numerous substantially circular holes in the skirt at the corners of the shadow mask. Yet further, Japanese Patent Laid-open No. 35657/1997 teaches technology for forming a plurality of stress-absorbing through holes 62. Yet further, Japanese Utility Model Laid-open No. 96250/1987 teaches technology for thinning by disposing non-through holes and grooves from the edges of the main surface to the skirt part.

In addition, the technology taught in Japanese Patent Laid-open No. 271849/1988 for disposing tabs protruding from the skirt in the direction substantially parallel to the CRT axis and away from the main surface, and fastening these tabs to the mask frame, is also taught in Japanese Utility Model Laid-open No. 5657/1973 and Japanese Patent Laid-open No. 73970/1974, 72545/1990, and 22048/1992 for preventing electron beam landing misses on the phosphor screen in conjunction with thermal expansion of the shadow mask.

SUMMARY OF THE INVENTION

With the technologies noted above for alleviating spring back by disposing a strength adjusting member to the shadow mask skirt, and for disposing hemispherical recesses of a specific diameter and depth to the outside of the shadow mask skirt, however, the drop in the bending rigidity of the skirt part is insufficient. Furthermore, the conventional technologies for thinning the skirt from the edges of the main mask surface and providing through-holes only in the skirt also insufficiently alleviate spring back, and the problem of main mask surface deformation occurring easily due to warping of the skirt when the radius of main mask surface curvature is great remains.

Furthermore, it is difficult to alleviate spring back in the skirt with the technology taught in Japanese Patent Laid-open No. 271849/1988 for disposing tabs protruding from the skirt in the direction substantially parallel to the CRT axis and away from the main surface, and fastening these tabs to the mask frame. Another problem is that the tabs affixed to the mask frame are displaced and cause deformation of the main mask surface in the heating steps of the color CRT manufacturing process. It should be further noted that this deformation of the main mask surface in such heating processes is also a problem in the other technologies cited above.

Therefore, a typical object of the present invention is to provide a color cathode ray tube that resolves the aforementioned problems and suppresses deformation of the color selection electrode, of which the shadow mask is typical.

A typical configuration of a color CRT according to the present invention has a main surface with a plurality of electron beam apertures and a substantially rectangular color selection electrode with a skirt part bent substantially perpendicularly to the main surface. Bending strength in the circumference direction of the skirt part differs from bending strength in the direction parallel to the tube axis due to a buffer part formed in the skirt part. This buffer part is formed from a plurality of recessed parts different in shape from the electron beam apertures. In addition, bending strength in the circumference direction is greater than bending strength in the direction parallel to the tube axis. The recessed parts are plural substantially rectangular grooves, the long side of which is aligned with the circumference direction of the skirt. The recessed parts can alternatively be substantially circular recesses, in which case the pitch therebetween in the circumference direction differs from the pitch in the tube axis direction.

Deformation of the main surface is avoided with this configuration when the skirt is press fit to the mask frame because rigidity (i.e., resistance) to the force applied to the skirt part is different in the circumference direction and the direction parallel to the tube axis.

A high resolution display can also be achieved because the plural electron beam apertures formed in the color selection electrode are substantially circular and a dot type phosphor layer is disposed. Furthermore, because there is at least 3 mm from the neck side edge of the skirt to the buffer, the color selection electrode can be pressed to form a shadow mask of desired shape without producing cracks in the skirt.

Yet further preferably, a first tab part is disposed on the skirt of the color selection electrode protruding from the skirt in a direction away from the main surface, and this first tab part is fastened to the mask frame. The skirt of the color selection electrode can thus be easily pressed to the mask frame. Deformation of the main surface due to displacement of the tab is reduced by providing one or a plurality of through holes in this first tab part.

Yet further preferably, a second tab part is formed on a corner part of the color selection electrode protruding in a direction away from the main surface. Main surface deformation is further reduced by fastening this second tab part to the mask frame.

DESCRIPTION OF THE PREFERRED EMBODIMENTS

Figure 2:
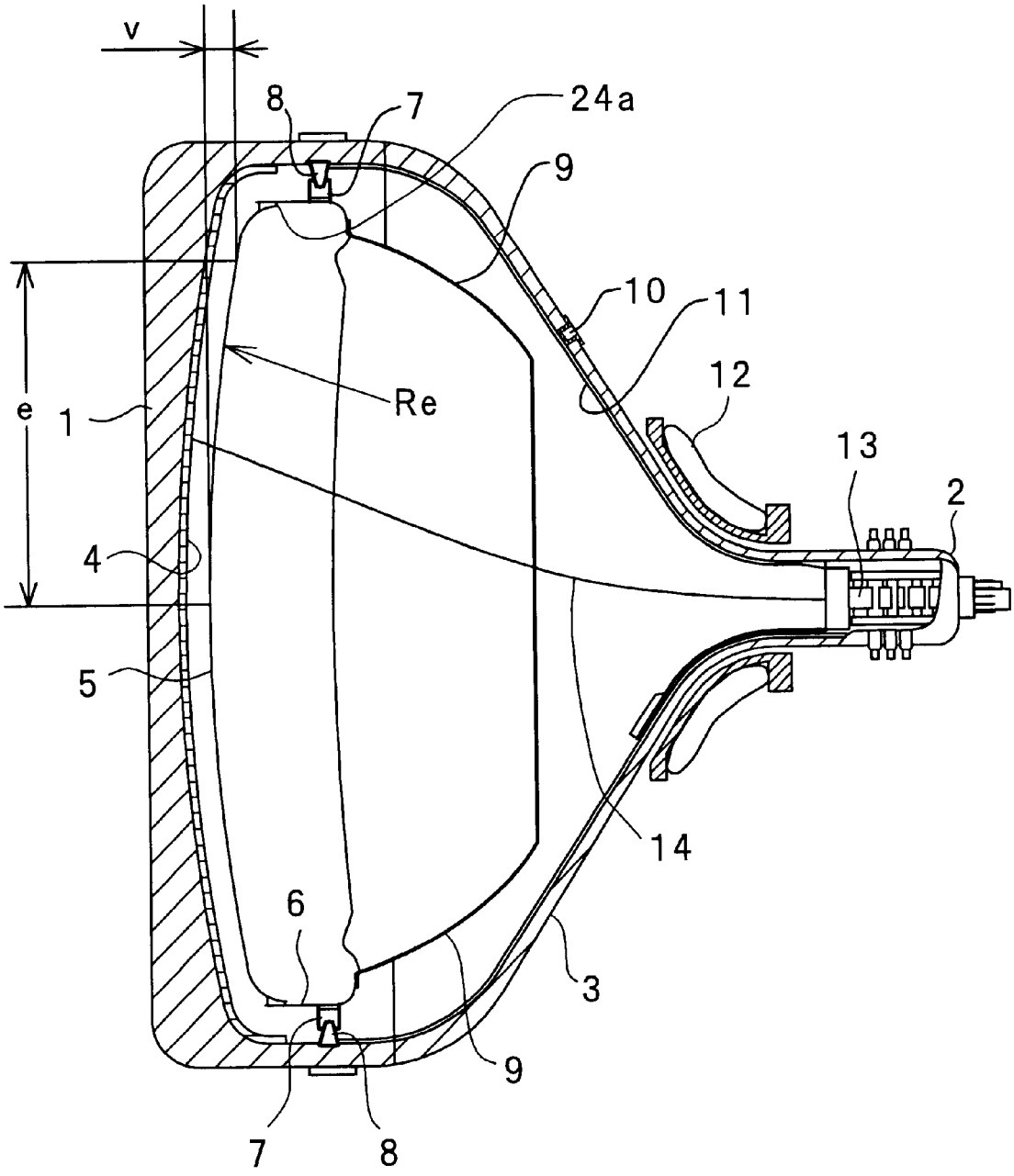
FIG. 2 is a section view for describing the overall structure of a shadow mask type color cathode ray tube according to a first preferred embodiment of the present invention.

The preferred embodiments of the present invention are described below with reference to the accompanying figures. FIG. 2 is a section view for describing the overall structure of a shadow mask type color cathode ray tube according to a first preferred embodiment of the present invention.

Shown in FIG. 2 are the panel 1, neck 2, funnel 3, phosphor layer 4 formed on the inside surface of the panel 1, and the shadow mask 5, which is a color selection electrode having numerous electron beam apertures. The shadow mask 5 is disposed coaxially to the phosphor layer 4 with a specific gap therebetween. As shown in FIG. 2, a mask frame 6 fixes and supports the shadow mask 5. Also shown in FIG. 2 are springs 7, panel pins 8, magnetic shield 9, anode button 10, internal conductive film 11, deflection yoke 12 for horizontal and vertical electron beam deflection, and electron guns 13 for emitting three (red (R), green (G), and blue (B)) in-line (one center beam and two side beams) electron beams 14 toward the phosphor layer 4.

As shown in FIG. 2, the mask frame 6 to which the shadow mask 5 and magnetic shield 9 are fixed is disposed to the panel pins 8 implanted in the panel 1 by way of intervening springs 7, the panel 1 and funnel 3 are fused together with frit glass, and the electron guns 13 are sealed inside the neck 2.

The three in-line electron beams 14 emitted from the electron guns 13 are deflected in two directions, that is, horizontally (the X direction) and vertically (the Y direction), by the deflection yoke 12 mounted at the transition between the neck 2 and funnel 3 so that the electron beams pass the shadow mask 5 (color selection electrode), bombard the phosphor layer 4, and form a picture.

With the color CRT according to this preferred embodiment shown in FIG. 2, the outside surface of the panel 1 is substantially flat, and the inside surface on which the phosphor layer 4 is formed to a concave shape, the curvature of which is not enough to impair the flatness of the displayed picture. The shadow mask 5 is a shape-retentive shadow mask formed to a specific curvature by pressing a 0.08 mm to 0.2 mm thick invar shadow mask blank. The shadow mask surface facing the inside surface of the panel 1 (that is, the main shadow mask surface) curves with a specific distance held from the inside surface of the panel 1. Because the outside surface of the panel 1 is substantially flat and the inside surface of the panel 1 and main surface of the shadow mask 5 are curved, the shadow mask 5 can be manufactured by a low cost press operation.

The main surface, including the porous region where the numerous electron beam apertures are formed, of the shadow mask 5 for a color CRT according to this preferred embodiment is substantially rectangular, and the radius of curvature of the main surface is different in the long, short, and diagonal axes of the shadow mask. This is to achieve flatness in the display screen and maintain mechanical strength in the formed shadow mask.

The shape of the main surface of the shadow mask 5 in a color CRT according to this preferred embodiment of the invention is aspheric, and the radius of curvature gradually decreases from the center to toward the edges of the main surface along each of the long, short, and diagonal axes of the main surface. The radius of curvature Rx along the long axis of the main shadow mask surface changes in the range from 1450 mm to 1250 mm, the radius of curvature Ry along the short axis changes in the range from 2000 mm to 1300 mm, and the radius of curvature Rd along the diagonal axis changes in the range from 1600 mm to 1250 mm. The radii of curvature of this aspheric shadow mask can be defined as equivalent radius of curvature Re using the following equation $$Re=(e^2+v^2)/(2v)$$

where, as shown in FIG. 2, e is the distance (mm) from the center of the main shadow mask surface to any peripheral position in a direction perpendicular to the tube axis, and v is the depth (mm) in the tube axis direction from the center of the main shadow mask surface at the above peripheral position.

The equivalent radius of curvature on the long axis of the main shadow mask surface can be greater than 1250 mm as noted above because the radius of curvature in the long axis direction on the inside surface of panel 1 has little flatness-diminishing effect even if it is slightly smaller than the radius of curvature in the short axis of the inside surface of panel 1.

Figure 1:
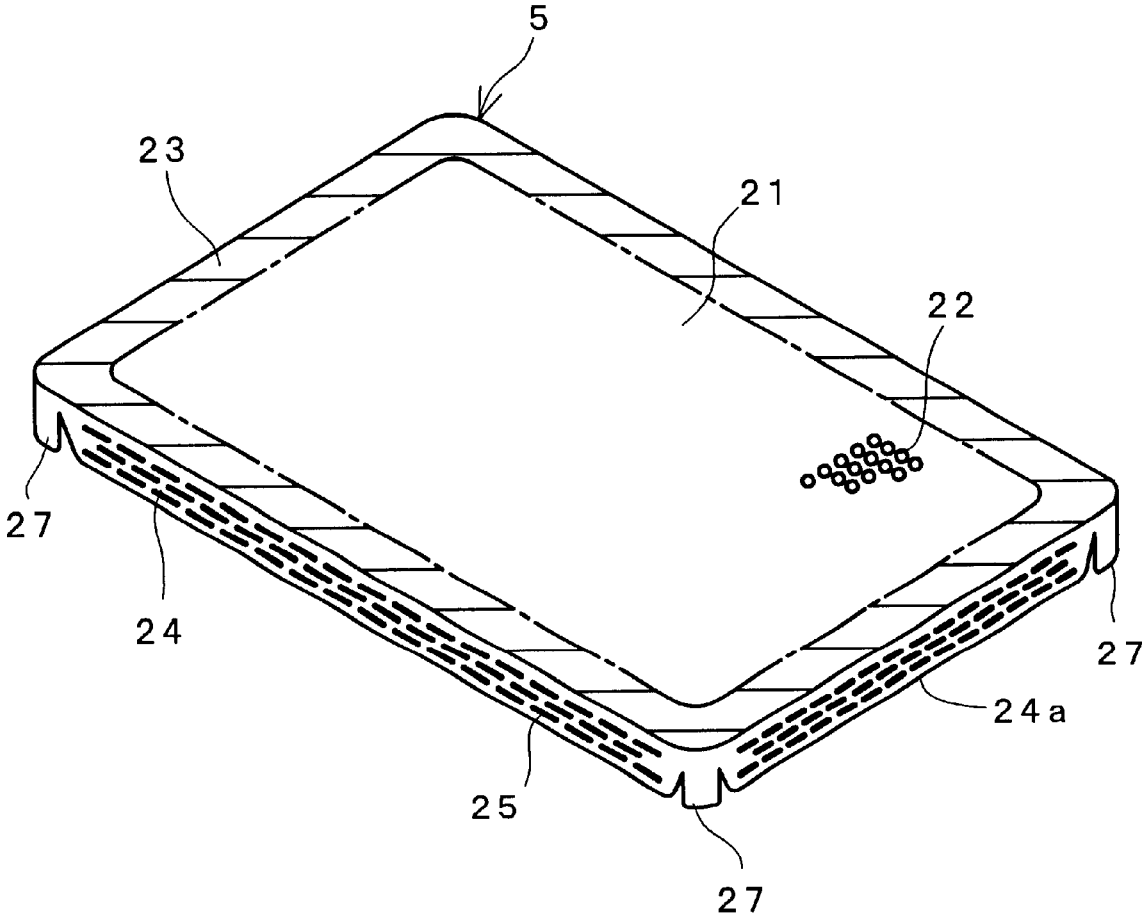
FIG. 1 is an oblique view of a press-formed shadow mask used in a color cathode ray tube according to a first preferred embodiment of the present invention.
Figure 3:
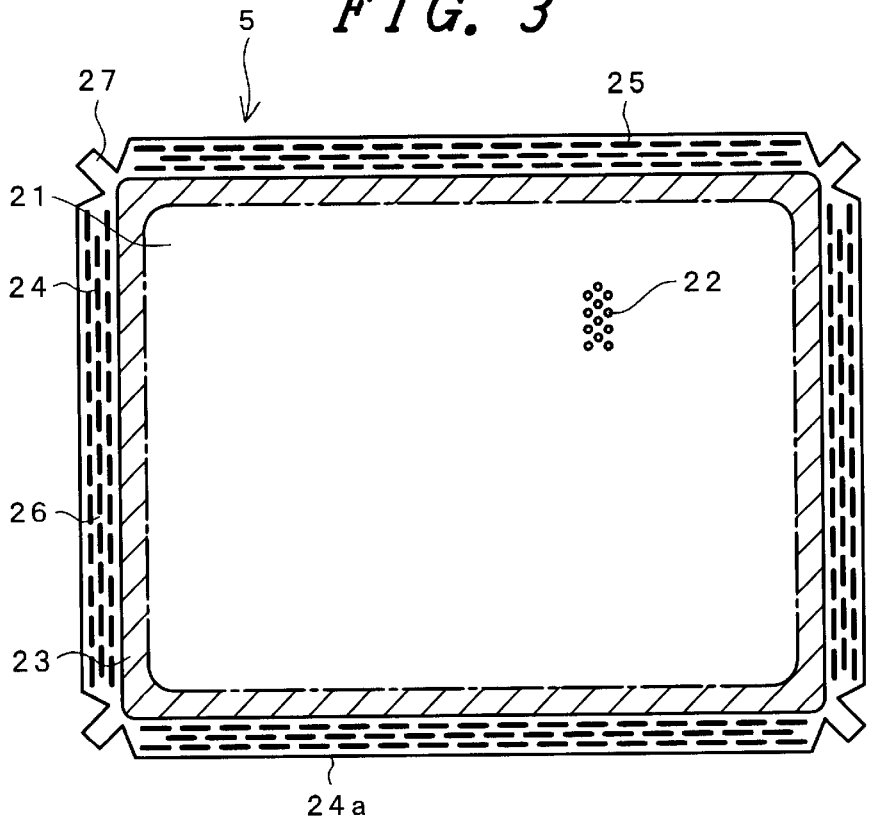
FIG. 3 is a plan view of a shadow mask blank before shaping for use in a color cathode ray tube according to a first preferred embodiment of the present invention.

FIG. 3 is a plan view of an exemplary shadow mask blank before press forming for use in a color CRT according to this preferred embodiment of the invention. Referring to FIG. 3, the main shadow mask surface 21 is the surface opposing the phosphor layer 4 on the inside of the panel 1 after the shadow mask is shaped. The main shadow mask surface 21 has an electron beam aperture area where the numerous dot-shaped electron beam apertures 22 are formed, and a main surface periphery 23, which has no electron beam apertures formed therein and which surrounds aperture area as indicated by the shading in FIG. 3. It should be noted that while the dot shape of the electron beam apertures 22 is preferably circular in order to achieve a high resolution display, the electron beam apertures 22 can be axially asymmetrical, such as oval or elliptical in shape, as a means of improving the landing error tolerance of the electron beams on the phosphor surface. The skirt 24 is disposed contacting the long and short sides on the outside of the main surface periphery 23. This shadow mask blank is pressed to shape as shown in FIG. 1 so that the skirt 24 bends substantially perpendicularly (on the neck side) to the main shadow mask surface 21.

Figure 4A:
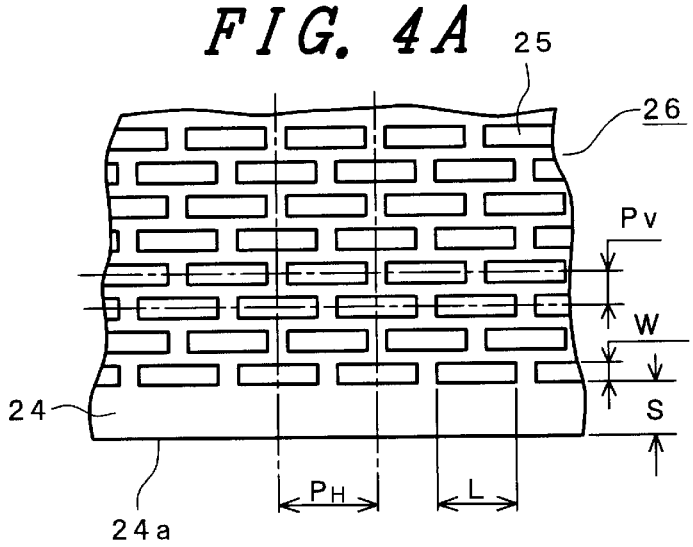
FIG. 4A and FIG. 4B are a plan view for describing the skirt portion and a section view of a rectangular groove, respectively, of a press-formed shadow mask for a color cathode ray tube according to a first preferred embodiment of the present invention.

As shown in FIG. 2, the pressed shadow mask is fastened to the inside of the mask frame 6 with the neck-side edge 24*a* facing the neck 2. As shown in FIG. 3 and FIG. 4A, numerous rectangular grooves 25 (recesses) recessed depthwise to the shadow mask blank are formed in the skirt 24 at a specific distance S from the neck-side edge 24*a*. As shown in FIG. 3 and FIG. 4A, these rectangular grooves 25 are arranged in rows around the periphery of the skirt so that the long sides of the rectangular grooves 25 follows the peripheral direction of the skirt (the outside circumference direction of the main shadow mask surface 21), thus forming a buffer 26. It should be noted that these rectangular grooves 25 are shaped differently to the electron beam apertures 22. Furthermore, when these rectangular grooves 25 are disposed to the skirt 24 on both the long and short sides of the main shadow mask surface 21, the long side of the rectangular grooves 25 is obviously different on the long and short sides of the skirt 24, that is, the grooves are offset substantially 90 degrees to each other. It is therefore difficult to form these rectangular grooves 25 in the same etching process used to form the electron beam apertures 22, and the rectangular grooves 25 are therefore formed in an etching process separate from that for the electron beam apertures 22 during the shadow mask blank manufacturing process. A corner tab 27 is formed at each corner. These corner tabs 27 are fastened at each corner of the mask frame 6.

In this preferred embodiment of the invention substantially the entire surface of the shadow mask is thinned by etching, except in the parts where the buffer 26 of the skirt 24 and the mask frame are welded together, and where the electron beam apertures 22 are formed.

It will be obvious to one with ordinary skill in the related art that while a buffer 26 is formed on all long and short sides of the skirt 24 in this preferred embodiment, it is also possible to form the buffer 26 only on the long sides or only on the short sides of the skirt 24.

Figure 4B:
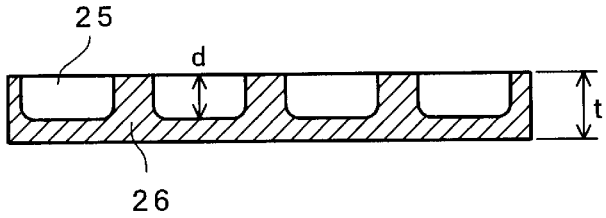

FIG. 4A is an enlarged plan view of part of the skirt 24 shown in FIG. 3. Note that like parts are identified by like reference numerals in both figures. Referring to FIG. 4A, the rectangular grooves 25 have a length L and width W, and are disposed throughout the skirt except in the area within distance S from the neck-side edge 24*a* of the skirt 24 at pitch PH in the circumferential direction of the skirt (that is, the direction following the outside circumference of the main shadow mask surface 21) and at pitch PV in the widthwise direction of the skirt (parallel to the tube axis). It will also be noted that rectangular grooves 25 in adjacent rows are offset from each other in the circumferential direction of the skirt. Preferably, rectangular grooves 25 in odd rows counted from the neck-side edge 24*a* and rectangular grooves 25 in even rows are mutually offset PH/2 in the circumferential direction of the skirt, producing a staggered (or mosaic) arrangement of grooves. Furthermore, the positions of rectangular grooves 25 in adjacent rectangular groove 25 rows overlap in part in the circumferential direction of the skirt. Note, further, that the rectangular grooves 25 are not formed where the skirt is welded to the mask frame. FIG. 4B is a typical section view of the rectangular grooves 25 formed in the buffer 26 of the skirt 24 in the skirt circumference direction. Note that t is the mask thickness in the skirt, and d is the rectangular groove depth.

Due to this mosaic arrangement of rectangular grooves 25, the bending strength of the skirt 24 in the mask thickness t direction is greater in the skirt circumference direction than in the skirt width direction. This is because the part of mask thickness t is contiguous and uninterrupted between adjacent rows of rectangular grooves 25 in the skirt circumference direction, but in the skirt width direction the part of mask thickness t is interrupted by the rectangular grooves 25. In other words, because bending rigidity is reduced in the skirt width direction, the bending load transferred to the main shadow mask surface 21 due to pressing the skirt 24 in is reduced when the shadow mask 5 is press fit into the mask frame 6. Shadow mask strength is thus improved and bending deformation of the shadow mask aperture area is reduced in the color CRT manufacturing process.

Specific dimensions for an exemplary shadow mask color CRT having a 100 degree deflection angle and an effective picture area with a diagonal size of 51 cm are as follows. That is, in an invar shadow mask 0.13 mm thick, rectangular grooves having a length L of 1.9 mm, width W of 0.5 mm, circumference direction pitch PH of 2.3 mm, and pitch PV in the direction parallel to the tube axis of 0.86 mm are disposed throughout the periphery except in the corners so that the distance S from neck-side edge 24*a* is 5 mm. The height of the skirt 24 thus formed is 10 mm in the center of the long side, and 7 mm at approximately 30 mm from the same corner.

These dimensions are determined according to the effective screen size of the CRT or the resolution of the phosphor screen pixels (phosphor pixels), but the length of the long side of the rectangular grooves is preferably from 0.9 mm to 4 mm, and the width of the short side is preferably approximately 0.2 mm to 1 mm so that the ratio between the long side and short side (L/W) is greater than 1.5. Note that if the long and short side lengths of these rectangular grooves are less than the above-noted values, the corners of the etched grooves will be rounded and it is difficult to achieve the desired shape. Furthermore, distance S is preferably 3 mm or more. If distance S is less than 3 mm, cracks tend to form in the skirt when the shadow mask blank is pressed.

Depth d of the rectangular grooves shown in FIG. 4B is not specifically limited insofar as the bending strength in the circumference direction of the skirt and the bending strength in the direction parallel to the tube axis differ as further described below. However, this depth d is preferably ¼ or more of mask thickness t in the skirt part, is yet further preferably ½ or more of mask thickness t in the skirt part, and the rectangular grooves must not pass through the skirt. It is not desirable for these grooves to pass entirely through the skirt because if they do cracks tend to form in the skirt when pressing the shadow mask blank.

Figure 5A:
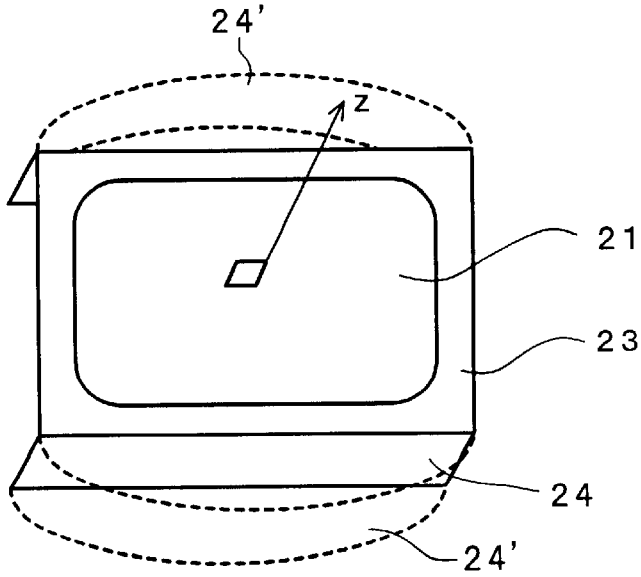
FIG. 5A and FIG. 5B are used to describe peripheral deformation of the skirt, and skirt deformation parallel to the CRT axis, respectively.
Figure 5B:
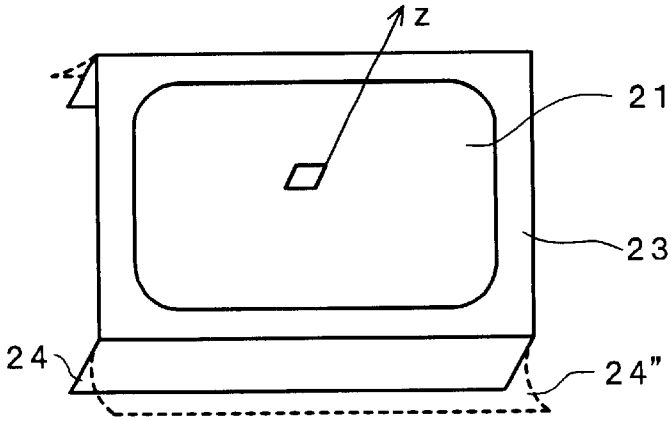

Bending strength in the circumference direction and axial direction (parallel to the tube axis) of a skirt in which these rectangular grooves are formed was investigated as follows. FIG. 5A shows the skirt 24' deformed in the circumference direction of skirt 24, and FIG. 5B shows skirt 24" deformed in the axial direction of skirt 24 (that is, parallel to the tube axis Z).

Figure 6A:
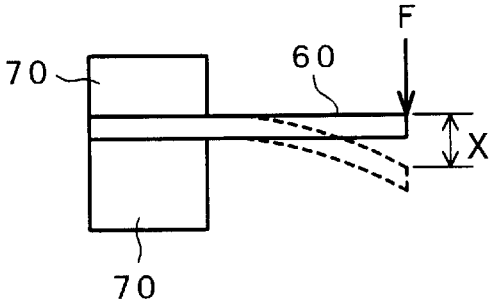
FIG. 6A and FIG. 6B are used to describe a method for measuring bending strength, FIG. 6A showing deformation from external force applied to a test piece, and FIG. 6B showing the shape of the test piece.
Figure 6B:
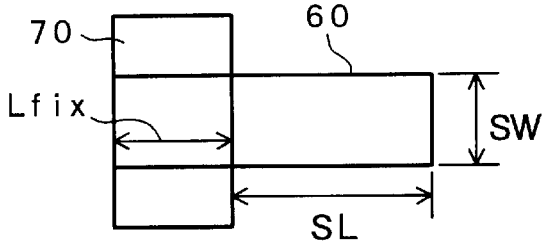

FIG. 6A and FIG. 6B illustrate the bending strength measuring method. As shown in FIG. 6A, the test piece 60 is held horizontally with one end thereof clamped in a clamping jig 70, and bending strength was obtained from the displacement X resulting from applying a constant force F vertically to the other end of the test piece. Note that as shown in FIG. 6B the test pieces 60 were cut from the shadow mask skirt in the circumference direction and the direction parallel to the tube axis so that width SW is 3 mm to 5 mm, the free end length SL is 10 mm, and the fixed end length Lfix is 10 mm.

The ratio of the bending strength in the circumference direction of the skirt and bending strength in the direction parallel to the tube axis, that is, the (circumference direction bending strength)/(bending strength parallel to tube axis) ratio was in the range 1.1 to 2 in this exemplary embodiment of the invention.

As shown in FIG. 1, the main shadow mask surface 21 is formed to a specific radius of curvature, and the skirt 24 is bent approximately perpendicularly (toward the neck) to the main surface 21 with buffer 26 formed on both the long and short sides of the skirt.

The radius of curvature of main surface 21 is set according to the radius of curvature of the inside surface of the panel part. The outside (front) surface of the panel part is substantially flat as shown in FIG. 2, and the inside surface curves so that the panel thickness at the periphery is approximately twice the panel thickness in the center due to considerations for the vacuum vessel strength and shadow mask forming strength. The equivalent radius of curvature of the main shadow mask surface is preferably 1250 mm or greater on the long axis as noted above due to the relationship to the curvature of the panel inside surface in order to maintain the desired flatness of the color CRT display. It will be noted that deformation of the main shadow mask surface occurs easily due to skirt deformation in a shadow mask thus requiring a large radius of curvature, but this deformation can be avoided by applying the present invention.

Alternative embodiments of a damper for a color selection electrode used in a color CRT according to the present invention are described next below with reference to FIG. 7 to FIG. 13.

Figure 7:
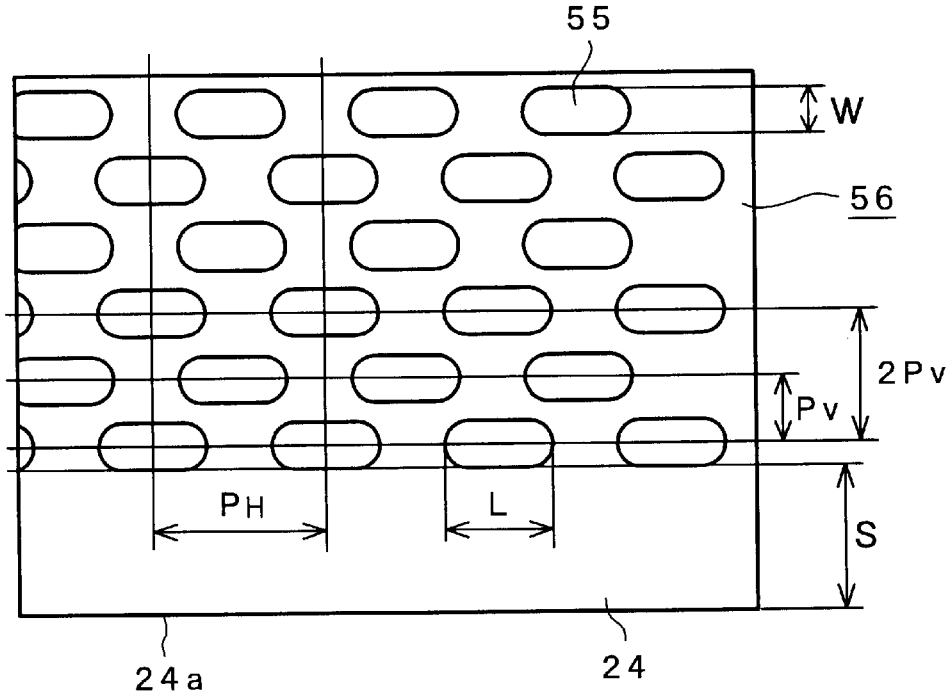
FIG. 7 is a plan view of the major parts of a damping member for the color selection electrode after press forming for use in a color cathode ray tube according to another preferred embodiment of the present invention.

FIG. 7 shows the skirt buffer in a color CRT having an invar shadow mask 0.13 mm thick with a 100 degree deflection angle and effective picture area with a diagonal size of 51 cm. More specifically, FIG. 7 shows an example in which buffer 56 is formed from numerous elliptical grooves 55 instead of the rectangular grooves 25 shown in FIG. 4A and FIG. 4B. In the buffer 56 shown in FIG. 7 length L of elliptical grooves 55 is 1.9 mm, width W is 0.5 mm, circumference pitch PH is 2.3 mm, pitch PV in the direction parallel to the tube axis is 0.86 mm, and distance S from neck-side edge 24*a* is 5 mm. These elliptical grooves 55 are also formed throughout the circumference of the skirt except at the corners. The height of skirt 24 thus formed is 10 mm at the center of the skit on the long side, and 7 mm approximately 30 mm from the corners.

These dimensions are determined according to the effective screen size of the CRT or the resolution of the phosphor screen pixels (phosphor pixels), but the length of the long side of the elliptical grooves is preferably from 0.2 mm to 4 mm, and the width of the short side is preferably approximately 0.1 mm to 1 mm so that the ratio between the long side and short side (L/W) is greater than 1.5. Distance S is preferably 3 mm or more. If distance S is less than 3 mm, cracks tend to form in the skirt when the shadow mask blank is pressed.

Depth d of the elliptical grooves shown in FIG. 7 is not specifically limited insofar as the bending strength in the circumference direction of the skirt and the bending strength in the direction parallel to the tube axis differ. However, this depth d is preferably ¼ or more of mask thickness t in the skirt part, is yet further preferably ½ or more of mask thickness t in the skirt part, and the elliptical grooves must not pass through the skirt. It is not desirable for these grooves to pass entirely through the skirt because if they do cracks tend to form in the skirt when pressing the shadow mask blank.

Figure 8:
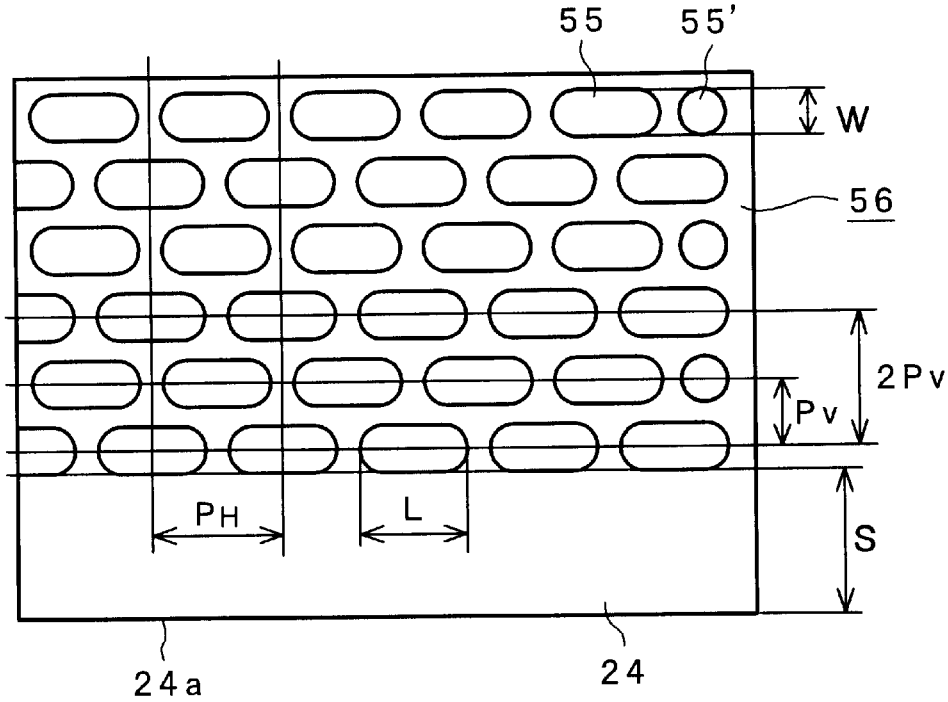
FIG. 8 is a plan view of the major parts of a damping member for the color selection electrode after press forming for use in a color cathode ray tube according to yet another preferred embodiment of the present invention.

FIG. 8 shows a variation of the invention in which buffer 56 is formed with elliptical grooves as shown in FIG. 7, and circular recesses 55' are further disposed to the corner ends of the buffer. Note that because circular recesses 55' of substantially the same diameter as the width W of the elliptical grooves are formed in the corner ends of the buffer 56, permanent deformation such as wrinkles does not easily occur when the skirt deforms in the circumference direction.

The ratio between the bending strength in the circumference direction and the bending strength in the direction parallel to the tube axis of the skirt, that is, (circumference direction bending strength)/(bending strength parallel to the tube axis), is also set to 1.1 to 2 in this exemplary embodiment.

Figure 9:
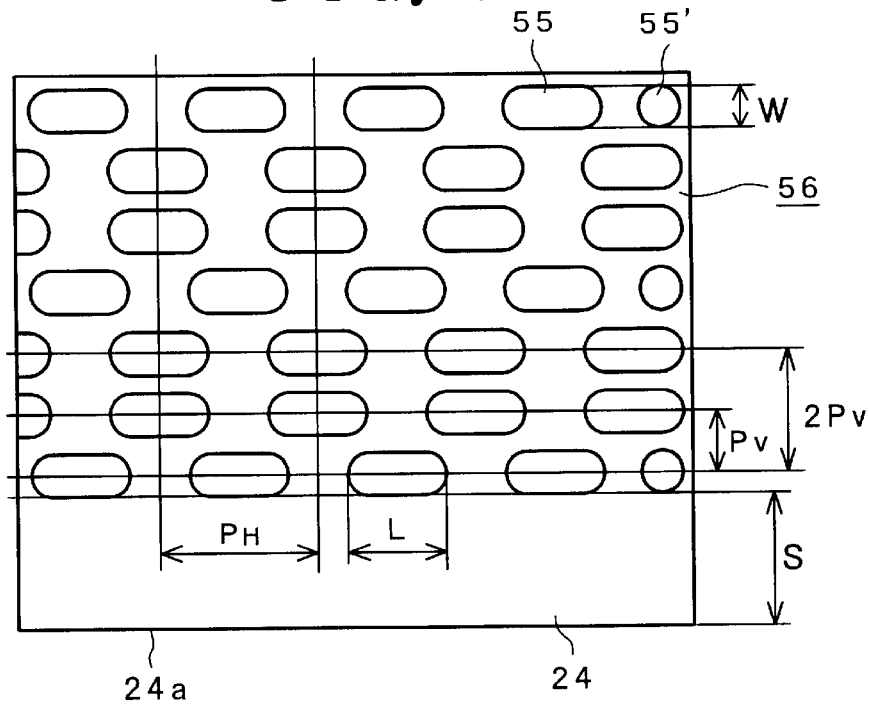
FIG. 9 is a plan view of the major parts of a damping member for the color selection electrode after press forming for use in a color cathode ray tube according to a yet further preferred embodiment of the present invention.

FIG. 9 shows an embodiment substantially identical to that shown in FIG. 8 except that the same pattern of elliptical grooves 55 disposed in the circumference direction to the buffer 56 is formed in two adjacent rows. That is, adjacent rows of elliptical grooves 55 are disposed with the positions of the elliptical grooves 55 therein not offset from each other in the circumference direction. Disposed between one set of such adjacent rows and another set of such adjacent rows is another row of elliptical grooves 55 in which the position of the elliptical grooves 55 therein is offset from the position of the elliptical grooves 55 in said adjacent rows. It should be noted that bending strength in the circumference direction and the bending strength in the direction parallel to the tube axis of the skirt differ in this embodiment, too.

Figure 10A:
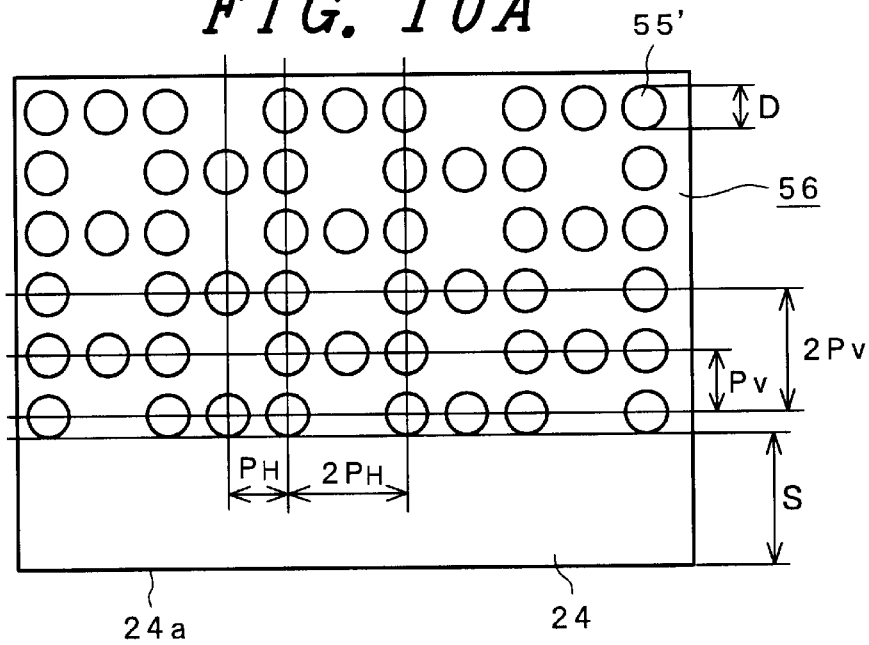
FIG. 10A and FIG. 10B are a plan view and section view, respectively, for describing a damping member for the color selection electrode after press forming for use in a color cathode ray tube according to a yet further preferred embodiment of the present invention.
Figure 10B:
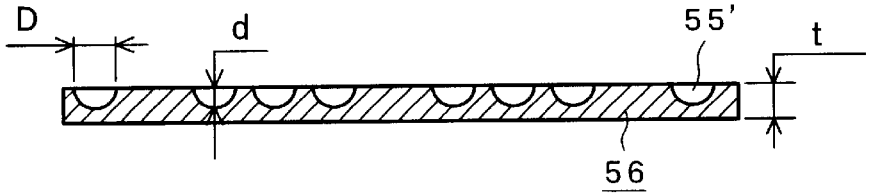

FIG. 10A shows a further alternative embodiment in which the buffer 56 is comprised of circular recesses 55' in the skirt 24. FIG. 10B is a section view for describing the damper shown in FIG. 10A. As shown in FIG. 10A, circular recesses 55' with a 0.13 mm diameter D are disposed in the skirt 24 at a pitch PH in the circumference direction of 0.53 mm or 1.06 mm (that is, twice 0.53 mm), pitch PV parallel to the tube axis of 0.49 mm, and distance S from neck-side edge 24*a* of 4 mm. These circular recesses 55' are disposed at circumferential pitch PH in the circumference direction in groups of three (referred to below as a "trio"), and trios are disposed in the circumference direction at four times the circumferential pitch PH, that is, a pitch of 4PH. Furthermore, trio positions in adjacent rows are offset from each other at an approximately 2PH pitch in the circumference direction. The result is a staggered pattern of circular recess 55' trios throughout the skirt. These dimensions are determined according to the effective screen size of the CRT and the phosphor pixel pitch, for example, but the distance S from neck-side edge 24*a* should be at least 3 mm or more so that cracks do not form in the skirt when the shadow mask is pressed.

Depth d of the circular recesses 55' shown in FIG. 10B is not specifically limited insofar as the bending strength in the circumference direction of the skirt and the bending strength in the direction parallel to the tube axis differ. However, this depth d is preferably ¼ or more of mask thickness t in the skirt part, is yet further preferably ½ or more of mask thickness t in the skirt part, and the circular recesses 55' must not pass through the skirt. It is not desirable for circular recesses 55' to pass entirely through the skirt because if they do cracks tend to form in the skirt when pressing the shadow mask blank.

Figure 11:
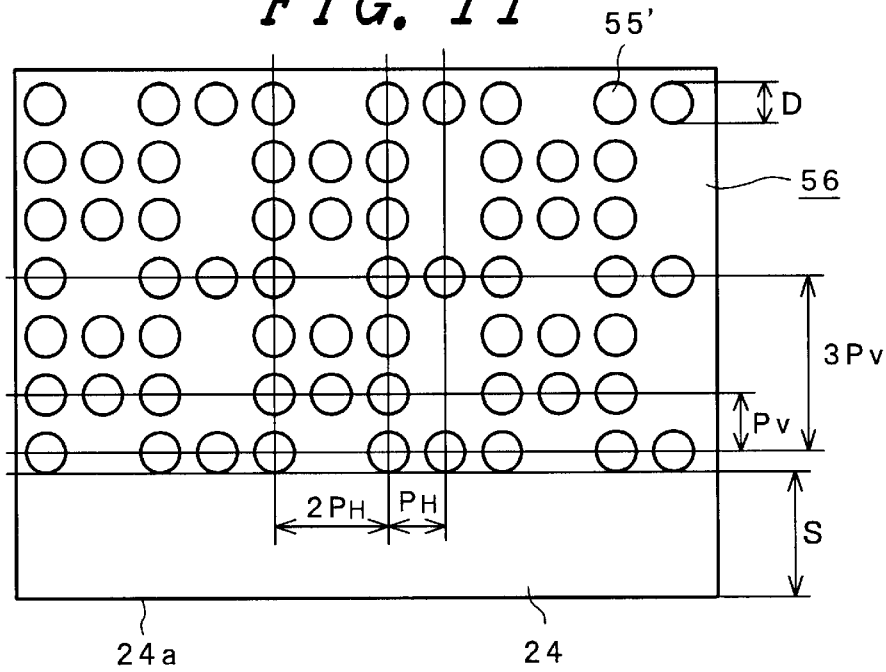
FIG. 11 is a plan view of the major parts of a damping member for the color selection electrode after press forming for use in a color cathode ray tube according to a yet further preferred embodiment of the present invention.

FIG. 11 shows an embodiment substantially identical to that shown in FIG. 10A except that the same pattern of circular recesses 55' disposed in the circumference direction to the buffer 56 is formed in two adjacent rows. That is, adjacent rows of circular recesses 55' are disposed with the positions of the circular recess trios therein not offset from each other in the circumference direction. Disposed between one set of such adjacent rows and another set of such adjacent rows is another row of circular recesses 55' offset approximately 2PH in the circumference direction from the position of the circular recesses 55' in said adjacent rows. It should be noted that bending strength in the circumference direction and the bending strength in the direction parallel to the tube axis of the skirt differ in this embodiment, too.

Alternative embodiments of a damper for a color selection electrode used in a color CRT according to the present invention are described next below with reference to FIG. 12 and FIG. 13.

Figure 12:
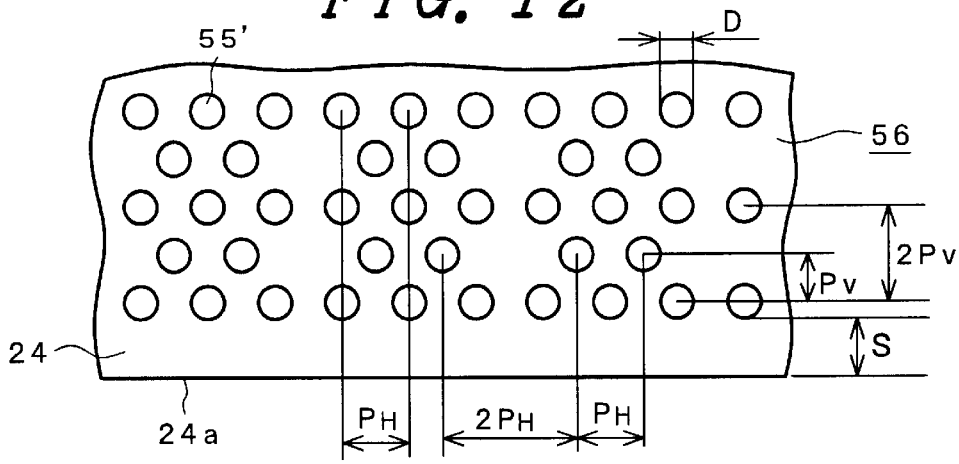
FIG. 12 is a plan view of the major parts of a damping member for the color selection electrode after press forming for use in a color cathode ray tube according to a yet further preferred embodiment of the present invention.

FIG. 12 shows an example in which the buffer 56 comprises numerous circular recesses 55'. Disposed throughout the skirt 24 except in the area to distance S from the neck-side edge 24*a,* circular recesses 55' are disposed in rows at circumferential pitch PH and pitch PV parallel to the tube axis alternating with rows in which the circular recesses 55' are disposed at circumferential pitch PH and pitch 2PH. More specifically, in alternating adjacent rows of circular recesses 55', the circular recesses 55' are disposed in one row at circumferential pitch PH and in the other row at pitches PH and 2PH. In addition, the positions of circular recesses 55' at circumferential pitch PH in the one row are offset PH/2 in the circumference direction from the position of the circular recesses 55' in the other row.

In FIG. 12 pitch PV parallel to the tube axis is 0.49 mm, circumferential pitch PH is 0.53 mm, circumferential pitch 2PH is 1.06 mm, and diameter D of circular recesses 55' is 0.13 mm. These dimensions are determined according to the effective screen size of the CRT and the phosphor pixel pitch, for example, but the distance S from neck-side edge 24*a* should be at least 3 mm or more so that cracks do not form in the skirt when the shadow mask is pressed.

Depth d of the circular recesses 55' shown in FIG. 12 is not specifically limited insofar as the bending strength in the circumference direction of the skirt and the bending strength in the direction parallel to the tube axis differ. However, this depth d is preferably ¼ or more of mask thickness t in the skirt part, is yet further preferably ½ or more of mask thickness t in the skirt part, and the circular recesses 55' must not pass through the skirt. It is not desirable for circular recesses 55' to pass entirely through the skirt because if they do cracks tend to form in the skirt when pressing the shadow mask blank.

Figure 13:
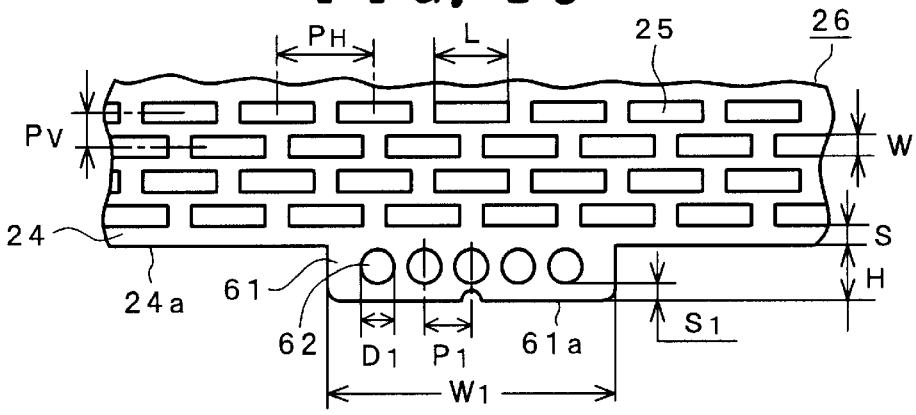
FIG. 13 is a plan view of the major parts of a damping member for the color selection electrode after press forming for use in a color cathode ray tube according to a yet further preferred embodiment of the present invention.

Next, FIG. 13 shows an embodiment in which a tab 61 is disposed protruding away from the main surface of the shadow mask from the neck-side edge 24*a* of the skirt 24 in which is formed a buffer 26 of rectangular grooves, and a plurality of stress-absorbing through holes 62 is formed in the tab 61. Note that the embodiment shown in FIG. 13 is identical to that shown in FIG. 4A except that stress-absorbing through holes 62 of diameter D1 are formed at pitch P1 distance S1 from the tab edge 61*a* in a tab 61 of height H and width W1.

Assuming a shadow mask type color CRT having a 100 degree deflection angle and effective diagonal screen size of 51 cm, specific exemplary dimensions in this embodiment are D1=6 mm, P1=8 mm, S1=5 mm, H=12 mm, and W1=50 mm. The tab 61 is affixed by welding to the mask frame.

Diameter D1 of the stress-absorbing through holes 62 can range from 2 mm to 8 mm according to the size of the tab 61. In this exemplary embodiment, too, bending strength in the circumference direction and the bending strength in the direction parallel to the tube axis of the skirt differ.

It should be noted that in the above embodiments the damper is provided on the outside surface side of the skirt, that is, the long grooves and recessed circles are formed on the side of the shadow mask skirt facing the panel part, but the long grooves and recessed circles can be formed on the inside surface side of the skirt, or on both the inside and outside surfaces.

Figure 14A:
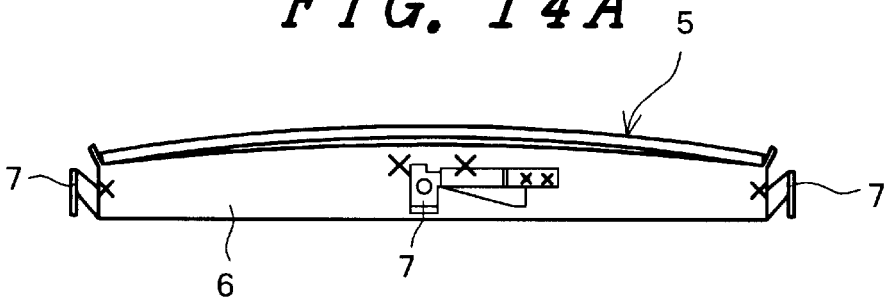
FIG. 14A, FIG. 14B, FIG. 14C, and FIG. 14D are a side view, plan view, section view, and oblique view, respectively, of a shadow mask assembly used in a color cathode ray tube according to a preferred embodiment of the present invention.
Figure 14B:
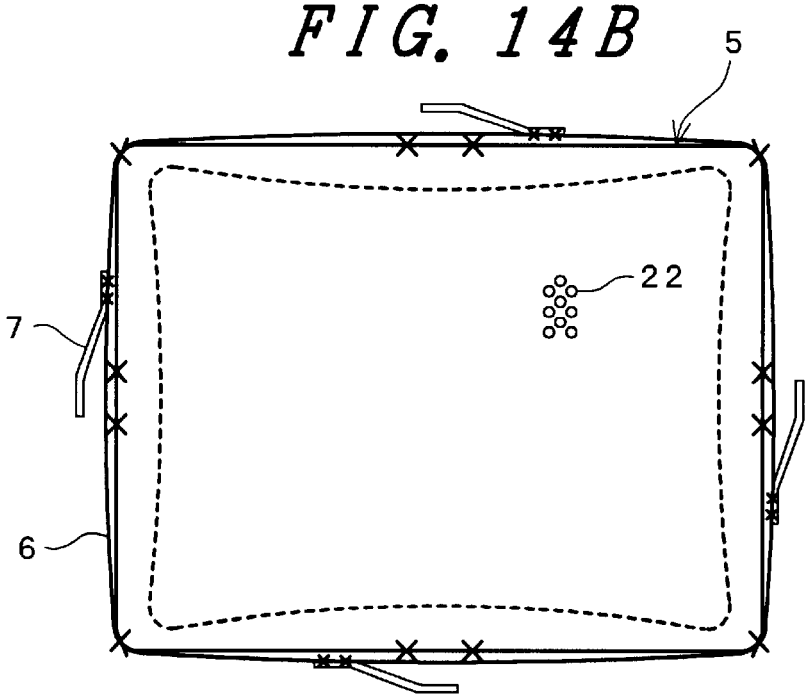
Figure 14C:
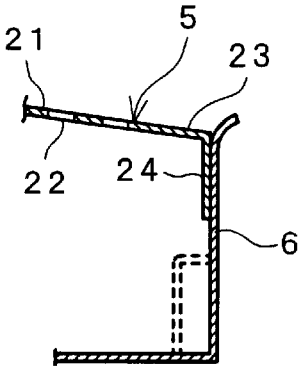
Figure 14D:
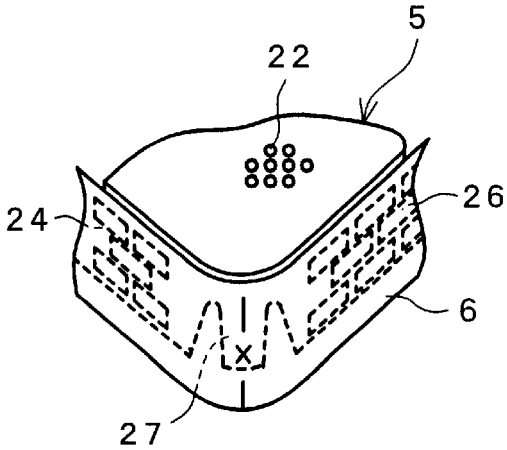

Next, FIG. 14A to FIG. 14D show an exemplary shadow mask assembly having the shadow mask according to the present invention fastened to the mask frame. FIG. 14A is a side view, FIG. 14B is a plan view, FIG. 14C is a partial section view showing the fastened position, and FIG. 14D is an oblique view of the corner. Note, further, that like parts in this and the other figures are identified by like reference numeral.

As shown in FIG. 14A to FIG. 14D, skirt 24 and corner tab 27 of shadow mask 5 are inserted inside mask frame 6, and fastened by welding at the positions marked by an x. Spring 7 is welded fast to each side of the mask frame 6. The shape of the mask frame can have a shoulder formed as indicated by the dotted line in FIG. 14C, for example.

The present invention shall not be limited to embodiments of a shadow mask type color CRT having a 100 degree deflection angle and 51 cm effective diagonal screen size, and other variations will be obvious to one skilled in the related art without departing from the scope of the following claims. For example, our invention can be obviously applied to color CRTs having an effective diagonal screen size of, for example, 41 cm or 46 cm.

As described above, by providing a buffer in which the bending strength in the circumference direction of the skirt and the bending strength parallel to the tube axis differ, the present invention suppresses deformation of the main shadow mask surface due to skirt deformation, and a color CRT featuring outstanding color purity can be achieved.

What is claimed is:

1. A color cathode ray tube having a substantially rectangular panel part on the inside surface of which is formed a phosphor layer, and a neck part housing electron guns, a vacuum vessel having a funnel part connecting the neck part and the panel part, a main surface having a plurality of electron beam apertures and disposed opposite the phosphor layer, a substantially rectangular shadow mask having a skirt part bent from the outside circumference of the main surface toward the neck part, a mask frame for supporting the shadow mask, and comprising:

a plurality of recessed parts in the shadow mask skirt part, the dimension of said recessed parts in the outside circumference direction of the main surface being greater that the dimension in the neck part direction, a shape of the recessed parts different from the electron beam aperture shape, the recessed parts arranged in rows in the outside circumference direction, a plurality of said recessed part rows being disposed in the neck part direction, and in adjacent rows of recessed parts, a position of recessed parts in one row is offset in the circumference direction from the position of recessed parts in the other row.

2. A color cathode ray tube as described in claim 1, wherein the equivalent radius of curvature along a long axis of the main surface of the shadow mask is 1250 mm or greater.

3. A color cathode ray tube as described in claim 1, wherein the recessed parts are rectangular in shape.

4. A color cathode ray tube as described in claim 1, wherein the recessed parts are elliptical in shape.

5. A color cathode ray tube as described in claim 1, wherein the electron beam apertures are circular in shape.

6. A color cathode ray tube as described in claim 1, wherein a distance from a neck part side edge of the skirt part to the buffer part is 3 mm or more.

7. A color cathode ray tube as described in claim 1, wherein in adjacent rows of recessed parts, a position of recessed parts in one row and a position of recessed parts in the other row partially overlap.

8. A color cathode ray tube as described in claim 1, wherein in adjacent rows of recessed parts where PH is a pitch between recessed parts in the circumference direction, the offset between recessed part positions in adjacent rows is PH/2.

9. A color cathode ray tube as described in claim 1, wherein in the plural rows of recessed parts a position of recessed parts in odd-numbered rows from the neck part side is offset in the circumference direction from a position of recessed parts in even-numbered rows.

10. A color cathode ray tube as described in claim 1, wherein the equivalent radius of curvature of the main surface of the shadow mask is different along the long axis and short axis.

* * * * *